US008216090B2

(12) United States Patent
Watanabe

(10) Patent No.: US 8,216,090 B2
(45) Date of Patent: Jul. 10, 2012

(54) GOLF BALL

(75) Inventor: Hideo Watanabe, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 105 days.

(21) Appl. No.: 12/469,740

(22) Filed: May 21, 2009

(65) Prior Publication Data

US 2010/0298067 A1 Nov. 25, 2010

(51) Int. Cl.
*A63B 37/06* (2006.01)

(52) U.S. Cl. ..... 473/373

(58) Field of Classification Search ..... 473/376, 473/373, 374

See application file for complete search history.

(56) References Cited

U.S. PATENT DOCUMENTS

| | | | | |
|---|---|---|---|---|
| 6,117,025 | A * | 9/2000 | Sullivan | 473/373 |
| 6,194,505 | B1 | 2/2001 | Sone et al. | |
| 6,561,925 | B2 | 5/2003 | Watanabe et al. | |
| 6,565,455 | B2 | 5/2003 | Hayashi et al. | |
| 6,565,456 | B2 * | 5/2003 | Hayashi et al. | 473/373 |
| 6,642,314 | B2 | 11/2003 | Sone et al. | |
| 7,294,680 | B2 | 11/2007 | Sone et al. | |
| 7,329,194 | B2 * | 2/2008 | Watanabe et al. | 473/376 |
| 7,445,566 | B2 | 11/2008 | Watanabe et al. | |
| 7,481,721 | B2 * | 1/2009 | Watanabe et al. | 473/376 |

FOREIGN PATENT DOCUMENTS

| | | | |
|---|---|---|---|
| JP | 11-35633 | A | 2/1999 |
| JP | 11-164912 | A | 6/1999 |
| JP | 2001-95947 | A | 4/2001 |
| JP | 2001-218873 | A | 8/2001 |
| JP | 2001-218875 | A | 8/2001 |
| JP | 2002-293996 | A | 10/2002 |
| JP | 2005-211656 | A | 8/2005 |
| JP | 2007-167257 | A | 7/2007 |

* cited by examiner

*Primary Examiner* — Raeann Gorden
(74) *Attorney, Agent, or Firm* — Sughrue Mion, PLLC

(57) ABSTRACT

The present invention provides a multi-piece solid golf ball having a core, an envelope layer, an intermediate layer, and a cover, in this order, and has formed on a surface thereof a plurality of dimples. The core has a hardness which gradually increases from a center to a surface thereof, the hardness difference in JIS-C hardness units between the core center and the core surface being at least 15 and, letting (I) be the average value for cross-sectional hardnesses at a position about 15 mm from the core center and at the core center and letting (II) be the cross-sectional hardness at a position about 7.5 mm from the core center, the hardness difference (I)-(II) in JIS-C units being not more than ±2. The envelope layer, intermediate layer and cover have hardnesses which satisfy the condition: cover hardness>intermediate layer hardness>envelope layer hardness.

6 Claims, 2 Drawing Sheets

GOLF BALL

BACKGROUND OF THE INVENTION

The present invention relates to a golf ball composed of a core, an intermediate layer and a cover that have been formed as successive layers. More specifically, the invention relates to a golf ball which has a good flight performance, a good durability to cracking and a good scuff resistance.

A variety of golf balls have hitherto been developed. Of these, three-piece solid golf balls having an optimized hardness relationship between an intermediate layer and a cover layer which encase the core are in wide use. In recent years, important elements in assessing ball performance include not only the flight performance, but also the durability of the ball to cracking and the scuff resistance—which is the ability to suppress burr formation on the ball surface. Designing the thickness, hardness and other properties of the respective ball layers in such a way as to maximize these desirable effects is another major challenge. Also, with regard to the use of golf balls, in addition to professionals and other skilled golfers, use by amateur golfers having a relatively low head speed is common. Hence, there exists a desire for the development of golf balls which, even when used by amateur golfers, enable a sufficient distance to be achieved.

Three-piece solid golf balls in which properties such as the thickness or hardness of the respective layers have been designed are disclosed in, for example, JP-A 2001-95497, JP-A 2001-218873, JP-A 2001-218875, JP-A 2005-211656 and JP-A 2007-167257.

However, these three-piece solid golf balls leave something to be desired in achieving a low spin rate on shots with a driver, and moreover do not always have sufficiently good ball properties such as durability to cracking and scuff resistance.

SUMMARY OF THE INVENTION

It is therefore an object of the present invention to provide a golf ball which is composed of a solid core, an intermediate layer and a cover, which achieves a low spin rate and has an excellent flight performance, and which also is endowed with an excellent durability to cracking on repeated impact and an excellent scuff resistance.

The inventors have conducted extensive investigations in order to achieve the above object. As a result, they have discovered that, with regard to the hardness profile of the core in a golf ball having a core, an intermediate layer and a cover, by focusing both on the hardness difference between the surface and center of the core and on the hardness gradient in the core and working to optimize these, and by also optimizing the hardness relationship between the intermediate layer and the cover which encase the core, surprisingly, a lower ball spin rate is achieved on full shots with a driver (W#1) by players such as amateur golfers who do not have a high head speed, thus improving the distance traveled by the ball, in addition to which the ball is also endowed with an excellent durability to cracking on repeated impact and an excellent scuff resistance.

Accordingly, the invention provides the following multi-piece solid golf balls.

[1] A golf ball comprising a core, an intermediate layer encasing the core, and a cover which encases the intermediate layer and has formed on a surface thereof a plurality of dimples, wherein the core is formed primarily of a rubber material; the intermediate layer and the cover are formed primarily of like or unlike resin materials; the core has a hardness which gradually increases from a center to a surface thereof, the hardness difference in JIS-C hardness units between the core center and the core surface being at least 15 and, letting (I) be the average value for cross-sectional hardnesses at a position about 15 mm from the core center and at the core center and letting (II) be the cross-sectional hardness at a position about 7.5 mm from the core center, the hardness difference (I)-(II) in JIS-C units being not more than ±2; and the intermediate layer and cover have hardnesses which satisfy the condition:

cover hardness>intermediate layer hardness.

[2] The golf ball of [1], wherein the intermediate layer and cover have thicknesses which satisfy the condition:

cover thickness≦intermediate layer thickness.

[3] The golf ball of [1], wherein the resin material of the intermediate layer is a mixture comprising:

100 parts by weight of a resin component comprised of (A) a base resin containing (a-1) an olefin-unsaturated carboxylic acid random copolymer and/or a metal ion neutralization product of an olefin-unsaturated carboxylic acid random copolymer and (a-2) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in proportions of (a-1)/(a-2)=100/0 to 0/100 (weight ratio), and (B) a non-ionomeric thermoplastic elastomer in proportions of A/B=100/0 to 50/50 (weight ratio);

(C) from 5 to 120 parts by weight of an organic fatty acid and/or organic fatty acid derivative having a molecular weight of from 228 to 1500; and (D) from 0.1 to 17 parts by weight of a basic inorganic metal compound capable of neutralizing unneutralized acid groups in the resin component and component C.

[4] The golf ball of [3], wherein component C is included in an amount of from 85 to 110 parts by weight per 100 parts by weight of the resin component.

[5] The golf ball of [1], wherein the resin material of the cover is a mixture comprising:

100 parts by weight of a resin component comprised of (A) a base resin containing (a-1) an olefin-unsaturated carboxylic acid random copolymer and/or a metal ion neutralization product of an olefin-unsaturated carboxylic acid random copolymer and (a-2) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in proportions of (a-1)/(a-2)=100/0 to 0/100 (weight ratio), and (B) a non-ionomeric thermoplastic elastomer in proportions of A/B=100/0 to 50/50 (weight ratio);

(C) from 0.1 to 10 parts by weight of an organic fatty acid and/or organic fatty acid derivative having a molecular weight of from 228 to 1500; and (D) from 0.1 to 5 parts by weight of a basic inorganic metal compound capable of neutralizing unneutralized acid groups in the resin component and component C.

[6] The golf ball of [1], wherein the hardness difference (I)-(II) in JIS-C units is not more than ±1.

[7] The golf ball of [1], wherein the intermediate layer and the cover have thicknesses which satisfy the condition:

$$\text{cover thickness} \times 1.5 \leqq \text{intermediate layer thickness}.$$

BRIEF DESCRIPTION OF THE DIAGRAMS

DETAILED DESCRIPTION OF THE INVENTION

The invention is described in greater detail below.

Figure 1:
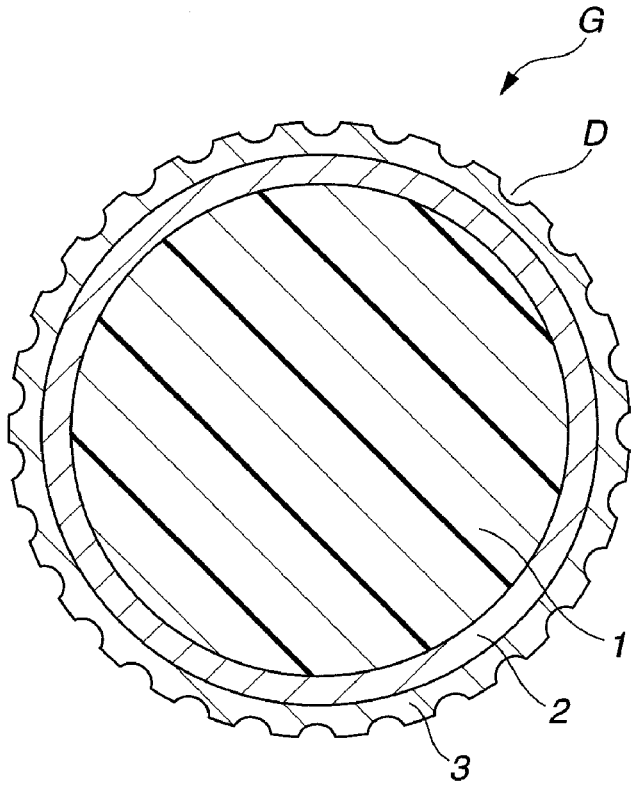
FIG. 1 is a schematic sectional view showing a golf ball (3-layer construction) according to the invention.

The golf ball of the present invention, as shown in FIG. 1, is a golf ball G having three or more layers, including a core 1, an intermediate layer 2 which encases the core, and a cover 3 which encases the intermediate layer. The cover 3 typically has a large number of dimples D formed on the surface thereof. The core 1 and the intermediate layer 2 are not limited to single layers, and may each be formed of a plurality of two more layers.

The core diameter, while not subject to any particular limitation, is generally at least 30 mm but not more than 40.5 mm, preferably at least 33 mm but not more than 39 mm, and more preferably at least 34 mm but not more than 38 mm. At a core diameter outside this range, the ball may have a lower initial velocity or may have a less than adequate spin rate-lowering effect after the ball is hit, as a result of which an increased distance may not be achieved. As mentioned above, the core is not limited to a single layer, and may be formed of a rubber base in a plurality of layers.

The surface hardness of the core, while not subject to any particular limitation, has a JIS-C hardness value of generally at least 68 but not more than 90, preferably at least 72 but not more than 85, and more preferably at least 75 but not more than 82. The center hardness of the core, while not subject to any particular limitation, has a JIS-C hardness value of generally at least 50 but not more than 70, preferably at least 54 but not more than 65, and more preferably at least 56 but not more than 62. If the above value is too small, the rebound characteristics of the core may be inadequate, as a result of which the ball may not achieve an increased distance, and the durability of the ball to cracking on repeated impact may worsen. On the other hand, if the above value is too high, the ball may have an excessively high spin rate on full shots, as a result of which an increased distance may not be achieved.

In the present invention, it is essential that the core have a hardness which gradually increases from the center to the surface thereof, the hardness difference in JIS-C units being at least 15, preferably from 16 to 40, and more preferably from 18 to 35. If the hardness difference is too small, the spin rate-lowering effect on shots with a driver (W#1) may be inadequate, as a result of which the desired distance may not be achieved. On the other hand, if the hardness difference is too large, the initial velocity on impact may decrease, as a result of which the desired distance may not be achieved, and the durability to cracking on repeated impact may worsen.

Figure 2:
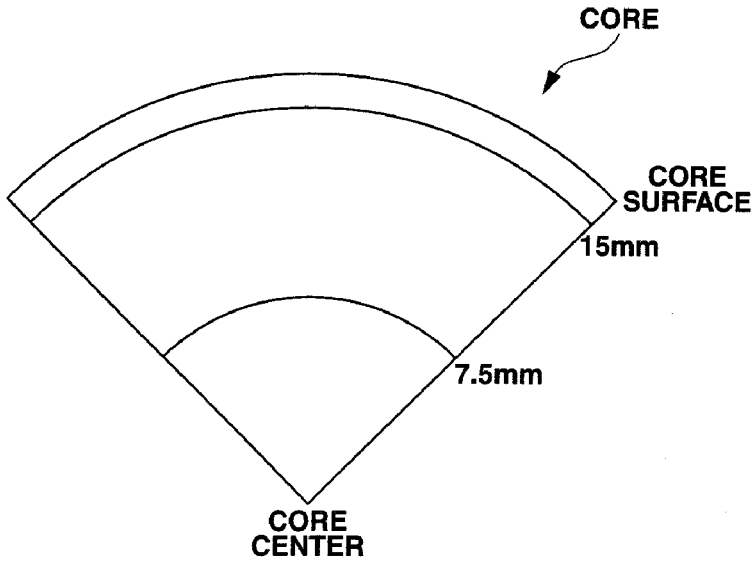
FIG. 2 is a diagram illustrating positions at the interior of the core.

Moreover, referring to FIG. 2, by optimizing the respective hardnesses at the center of the core and at cross-sectional positions located about 7.5 mm and about 15 mm from the core center, the spin rate-lowering effect on shots taken with a W#1 can be enhanced. Specifically, letting (I) be the average value for cross-sectional hardnesses at a position 15 mm from the core center and at the core center and letting (II) be the cross-sectional hardness at a position 7.5 mm from the core center, it is critical for the hardness difference (I)-(II) therebetween in JIS-C units to be not more than ±2. This means that, referring to FIG. 3, if, for example, the core center has a JIS hardness of 61 and the JIS hardness at a position 15 mm outward from the core center is 77, with the average thereof being a JIS hardness of about 69, the hardness at a position 7.5 mm from the core center (corresponding to a point midway between the core center and the position 15 mm from the core center) is held within a range of ±2 of the above average value of 69.

Figure 3:
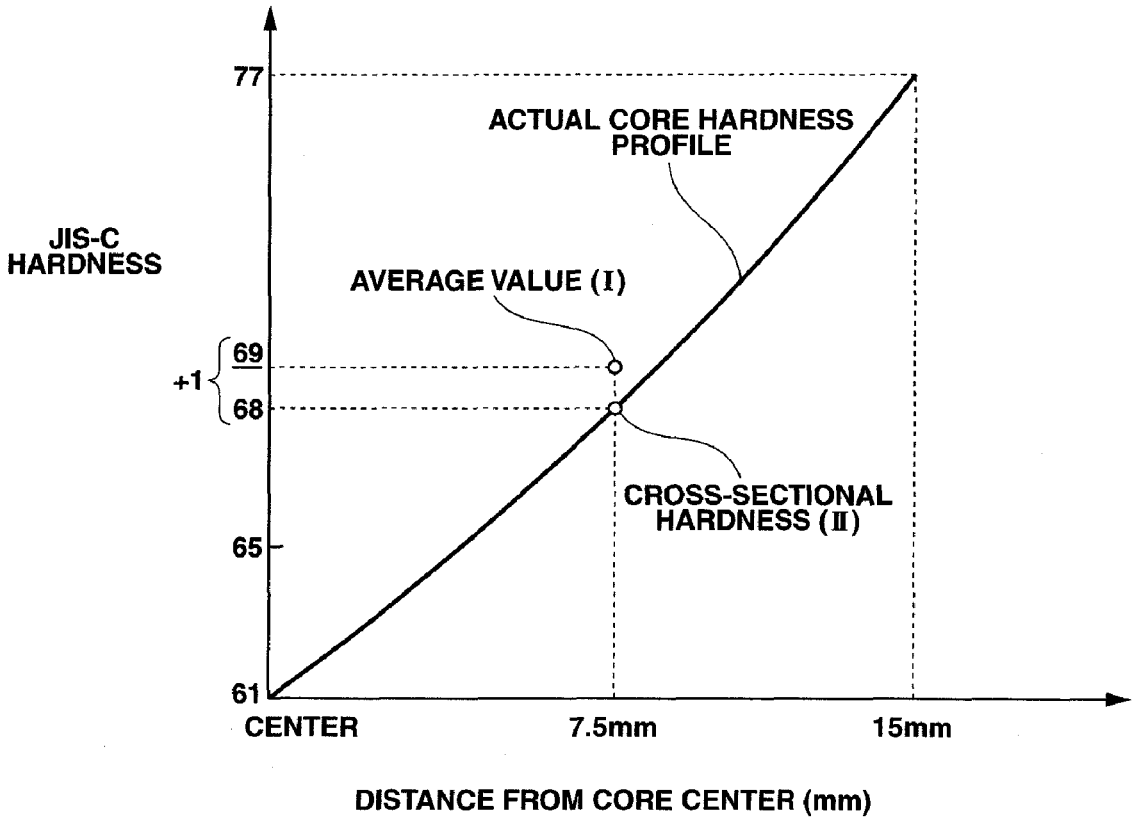
FIG. 3 is a diagram showing examples of hardnesses at the core center and at positions away from the center.

That is, as shown in FIG. 3, it is desirable for the hardness profile to have an approximately linear gradient from the core center outward.

The above hardness difference (I)-(II) is preferably not more than ±1 JIS-C hardness unit, and is more preferably ±0; that is, identical to the above average value. If the hardness difference is too large, the spin rate-lowering effect on shots with a W#1 may be inadequate, as a result of which the desired distance may not be achieved.

The deflection when the core is subjected to loading, i.e., the deflection of the core when compressed under a final load of 1,275 N (130 kgf) from an initial load of 98 N (10 kgf), while not subject to any particular limitation, is preferably set within a range of 2.0 mm to 8.0 mm, more preferably 3.0 mm to 7.0 mm, and even more preferably 3.5 mm to 6.0 mm. If this value is too high, the core may lack sufficient rebound, which may result in a less than satisfactory distance, or the durability of the ball to cracking on repeated impact may worsen. On the other hand, if this value is too low, the ball may have an excessively hard feel on full shots, and the spin rate may be too high, as a result of which an increased distance may not be achieved.

A material composed primarily of rubber may be used to form the core having the above-described surface hardness and deflection. For example, the core may be formed of a rubber composition containing, in addition to the rubber component, a co-crosslinking agent, an organic peroxide, an inert filler, an organosulfur compound and the like. It is preferable to use polybutadiene as the base rubber of this rubber composition. In the present invention, as mentioned above, it is critical that the hardness gradually increase from the center to the surface of the core, and it is essential for the core cross-sectional hardness profile to be optimized in a specific way. To this end, it is necessary to suitably adjust, for example, the amounts in which various additives are included in the core composition, and also the vulcanization temperature and the vulcanization time. Also, in the core composition, although the outcome will vary also with the type of composition and the vulcanization conditions, when sulfur, for example, is included, there is a possibility that, during rubber vulcanization, the region near the center of the core will end up being soft, as a result of which the desired linear hardness gradient may not be achieved.

It is desirable for the polybutadiene serving as the rubber component to have a cis-1,4-bond content on the polymer chain of at least 60 wt %, preferably at least 80 wt %, more preferably at least 90 wt %, and most preferably at least 95 wt %. Too low a cis-1,4-bond content among the bonds on the molecule may lead to a lower resilience. Moreover, the polybutadiene has a 1,2-vinyl bond content on the polymer chain of typically not more than 2%, preferably not more than 1.7%, and even more preferably not more than 1.5%. Too high a 1,2-vinyl bond content may lead to a lower resilience.

To obtain a molded and vulcanized rubber composition of good resilience, the polybutadiene used in the invention is preferably one synthesized with a rare-earth catalyst or a Group VIII metal compound catalyst. Polybutadiene synthesized with a rare-earth catalyst is especially preferred.

Such rare-earth catalysts are not subject to any particular limitation. Exemplary rare-earth catalysts include those made up of a combination of a lanthanide series rare-earth compound with an organoaluminum compound, an alumoxane, a halogen-bearing compound and an optional Lewis base.

Examples of suitable lanthanide series rare-earth compounds include halides, carboxylates, alcoholates, thioalcoholates and amides of atomic number 57 to 71 metals.

In the practice of the invention, the use of a neodymium catalyst in which a neodymium compound serves as the lanthanide series rare-earth compound is particularly advantageous because it enables a polybutadiene rubber having a high cis-1,4 bond content and a low 1,2-vinyl bond content to be obtained at an excellent polymerization activity. Suitable examples of such rare-earth catalysts include those mentioned in JP-A 11-35633, JP-A 11-164912 and JP-A 2002-293996.

To enhance the resilience, it is preferable for the polybutadiene synthesized using the lanthanide series rare-earth compound catalyst to account for at least 10 wt %, preferably at least 20 wt %, and more preferably at least 40 wt %, of the rubber components.

Rubber components other than the above-described polybutadiene may be included in the base rubber insofar as the objects of the invention are attainable. Illustrative examples of rubber components other than the above-described polybutadiene include other polybutadienes, and other diene rubbers, such as styrene-butadiene rubber, natural rubber, isoprene rubber and ethylene-propylene-diene rubber.

Examples of co-crosslinking agents include unsaturated carboxylic acids and the metal salts of unsaturated carboxylic acids.

Specific examples of unsaturated carboxylic acids include acrylic acid, methacrylic acid, maleic acid and fumaric acid. Acrylic acid and methacrylic acid are especially preferred.

The metal salts of unsaturated carboxylic acids, while not subject to any particular limitation, are exemplified by the above-mentioned unsaturated carboxylic acids neutralized with a desired metal ion. Specific examples include the zinc and magnesium salts of methacrylic acid and acrylic acid. The use of zinc acrylate is especially preferred.

The unsaturated carboxylic acid and/or metal salt thereof is included in an amount, per 100 parts by weight of the base rubber, of generally at least 5 parts by weight, preferably at least 10 parts by weight, and more preferably at least 15 parts by weight, but generally not more than 60 parts by weight, preferably not more than 50 parts by weight, more preferably not more than 40 parts by weight, and most preferably not more than 30 parts by weight. Too much may make the core too hard, giving the ball an unpleasant feel on impact, whereas too little may lower the rebound.

The organic peroxide may be a commercially available product, suitable examples of which include Percumyl D (produced by NOF Corporation), Perhexa 3M (NOF Corporation), Perhexa C40 (NOF Corporation) and Luperco 231XL (Atochem Co.). These may be used singly or as a combination of two or more thereof.

The amount of organic peroxide included per 100 parts by weight of the base rubber is generally at least 0.1 part by weight, preferably at least 0.3 part by weight, more preferably at least 0.5 part by weight, and most preferably at least 0.7 part by weight, but generally not more than 5 parts by weight, preferably not more than 4 parts by weight, more preferably not more than 3 parts by weight, and most preferably not more than 2 parts by weight. Too much or too little organic peroxide may make it impossible to achieve a ball having a good feel, durability and rebound.

Examples of suitable inert fillers include zinc oxide, barium sulfate and calcium carbonate. These may be used singly or as a combination of two or more thereof.

The amount of inert filler included per 100 parts by weight of the base rubber is generally at least 1 part by weight, and preferably at least 5 parts by weight, but generally not more than 100 parts by weight, preferably not more than 80 parts by weight, and more preferably not more than 60 parts by weight. Too much or too little inert filler may make it impossible to achieve a proper weight and a good rebound.

In addition, an antioxidant may be included if necessary. Illustrative examples of suitable commercial antioxidants include Nocrac NS-6, Nocrac NS-30, Nocrac 200 (all available from Ouchi Shinko Chemical Industry Co., Ltd.), and Yoshinox 425 (available from Yoshitomi Pharmaceutical Industries, Ltd.). These may be used singly or as a combination of two or more thereof.

The amount of antioxidant included per 100 parts by weight of the base rubber is generally at least 0 part by weight, preferably at least 0.05 part by weight, and more preferably at least 0.1 part by weight, but generally not more than 3 parts by weight, preferably not more than 2 parts by weight, more preferably not more than 1 part by weight, and most preferably not more than 0.5 part by weight. Too much or too little antioxidant may make it impossible to achieve a suitable core hardness gradient, a good rebound and durability, and a spin rate-lowering effect on full shots.

The core may be produced by curing and vulcanizing the rubber composition containing the various above ingredients according to a known method. For example, the core may be produced by masticating the core composition using a mixing apparatus such as a Banbury mixer or roll mill, then compression molding or injection molding the masticated material in a core mold, and curing the molded body by suitably heating at a temperature sufficient for the organic peroxide and co-crosslinking agent to act, typically under conditions of about 130 to 170° C., and especially 150 to 160° C., for 10 to 40 minutes, and especially 12 to 20 minutes.

Next, the intermediate layer and cover materials are described. The principal materials making up these parts of the golf ball are not subject to any particular limitation; use may be made of like or unlike thermoplastic resins or thermoplastic elastomers. Examples include ionomeric resins, polyester elastomers and urethane resins. The principal materials making up these parts of the golf ball preferably include:

(A) a base resin containing (a-1) an olefin-unsaturated carboxylic acid random copolymer and/or a metal ion neutralization product of an olefin-unsaturated carboxylic acid random copolymer, and (a-2) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in proportions of (a-1)/(a-2)=100/0 to 0/100 (weight ratio); and (B) a non-ionomeric thermoplastic elastomer in proportions of A/B=100/0 to 50/50 (weight ratio). These principal materials are more preferably mixtures which include 100 parts by weight of a resin component composed of above base resin (A) and above non-ionomeric thermoplastic elastomer (B) in proportions of A/B=100/0 to 50/50 (weight ratio), and specific respective amounts of:

(C) an organic fatty acid and/or organic fatty acid derivative having a molecular weight of 228 to 1500, and (D) a basic inorganic metal compound capable of neutralizing unneutralized acid groups in the resin component and component C.

The above mixture is used as the principal material in preferably at least one layer among the intermediate layer and the cover, more preferably two or more of these layers, and most preferably all of these layers.

For the cover (outer layer), use is most preferably made of a material composed primarily of an ionomer.

It is preferable to use, as the olefin in above component (a-1) and above component (a-2), an olefin in which the number of carbons is generally at least 2 but not more than 8, and preferably not more than 6. Specific examples include ethylene, propylene, butene, pentene, hexene, heptene and octene. Ethylene is especially preferred.

Examples of unsaturated carboxylic acids include acrylic acid, methacrylic acid, maleic acid and fumaric acid. Acrylic acid and methacrylic acid are especially preferred.

The unsaturated carboxylic acid ester in above component (a-2) is exemplified by lower alkyl esters of the above unsaturated carboxylic acids. Illustrative examples include methyl methacrylate, ethyl methacrylate, propyl methacrylate, butyl methacrylate, methyl acrylate, ethyl acrylate, propyl acrylate and butyl acrylate. The use of butyl acrylate (n-butyl acrylate, i-butyl acrylate) is especially preferred.

The olefin-unsaturated carboxylic acid random copolymer of above component (a-1) and the olefin-unsaturated carboxylic acid-unsaturated carboxylic acid ester random terpolymer of above component (a-2) (these are sometimes referred to collectively below as "random copolymers") can each be obtained by using a known method to random copolymerize the above-described olefin, unsaturated carboxylic acid and, where necessary, unsaturated carboxylic acid ester.

It is desirable that the above random copolymers have controlled unsaturated carboxylic acid contents (acid contents). In this case, the content of unsaturated carboxylic acid in component (a-1) is generally at least 4 wt %, preferably at least 6 wt %, more preferably at least 8 wt %, and even more preferably at least 10 wt %, but generally not more than 30 wt %, preferably not more than 20 wt %, more preferably not more than 18 wt %, and most preferably not more than 15 wt %. The content of unsaturated carboxylic acid in component (a-2) is generally at least 4 wt %, preferably at least 6 wt %, and more preferably at least 8 wt %, but generally not more than 15 wt %, preferably not more than 12 wt %, and more preferably not more than 10 wt %.

If the unsaturated carboxylic acid content in above component (a-1) and/or component (a-2) is too low, the ball rebound may decrease, whereas if it is too high, the moldability of the resin material may decrease.

The metal ion neutralization product of the olefin-unsaturated carboxylic acid random copolymer of above component (a-1) and the metal ion neutralization product of the olefin-unsaturated carboxylic acid-unsaturated carboxylic acid ester random terpolymer of above component (a-2) (these are referred to collectively below as "metal ion neutralization products of the random copolymers") can be obtained by neutralizing some or all of the acid groups on the respective above random copolymers with metal ions.

Illustrative examples of metal ions for neutralizing acid groups in the above random copolymers include $Na^+$, $K^+$, $Li^+$, $Zn^{++}$, $Cu^{++}$, $Mg^{++}$, $Ca^{++}$, $Co^{++}$, $Ni^{++}$ and $Pb^{++}$. Of these, $Na^+$, $Li^+$, $Zn^{++}$ and $Mg^{++}$ are preferred. From the standpoint of improving resilience, the use of $Na^+$ or $Mg^{++}$ is even more preferred.

The method for obtaining metal ion neutralization products of the above random copolymers using such metal ions may involve neutralization by adding, for example, compounds such as formates, acetates, nitrates, carbonates, bicarbonates, oxides, hydroxides and alkoxides of the above-mentioned metal ions to the above random copolymers having acid groups. In the present invention, no particular limitation is imposed on the degree of neutralization of the above acid groups by these metal ions.

Commercially available products may be used as above component (a-1) and above component (a-2). Examples of commercial products that may be used as the random copolymer in above component (a-1) include Nucrel 1560, Nucrel 1214 and Nucrel 1035 (all products of DuPont-Mitsui Polychemicals Co., Ltd.), and Escor 5200, Escor 5100 and Escor 5000 (all products of ExxonMobil Chemical). Examples of commercial products that may be used as the metal ion neutralization product of a random copolymer in above component (a-1) include Himilan 1554, Himilan 1557, Himilan 1601, Himilan 1605, Himilan 1706 and Himilan AM7311 (all products of DuPont-Mitsui Polychemicals Co., Ltd.), Surlyn 7930 (E.I. DuPont de Nemours & Co.), and Iotek 3110 and Iotek 4200 (ExxonMobil Corporation). Examples of commercial products that may be used as the random copolymer in above component (a-2) include Nucrel AN 4311 and Nucrel AN 4318 (both products of DuPont-Mitsui Polychemicals Co., Ltd.), and Escor ATX325, Escor ATX320 and Escor ATX310 (all products of ExxonMobil Chemical). Examples of commercial products that may be used as the metal ion neutralization product of a random copolymer in above component (a-2) include Himilan 1855, Himilan 1856 and Himilan AM7316 (all products of DuPont-Mitsui Polychemicals Co., Ltd.), Surlyn 6320, Surlyn 8320, Surlyn 9320 and Surlyn 8120 (all products of E.I. DuPont de Nemours & Co.), and Iotek 7510 and Iotek 7520 (both products of ExxonMobil Chemical). These may be used singly or in combinations of two or more thereof as the respective components.

Examples of sodium-neutralized ionomeric resins, which are preferred as the metal ion neutralization products of the above random copolymers, include Himilan 1605, Himilan 1601 and Surlyn 8120.

The amount of above component (a-2), as a proportion of the combined amount of components (a-1) and (a-2), is generally at least 0 wt %, and preferably at least 50 wt %, with the upper limit being generally 100 wt % or less.

The above-mentioned non-ionomeric thermoplastic elastomer (B) is a component which is preferably included so as to further improve the feel of the golf ball on impact and the rebound. In the present invention, the base resin (A) and the non-ionomeric thermoplastic elastomer (B) are sometimes referred to collectively as "the resin components." Examples of such non-ionomeric thermoplastic elastomers (B) include olefin elastomers, styrene elastomers, polyester elastomers, urethane elastomers and polyamide elastomers. To further increase the rebound, it is preferable to use an olefin elastomer or a polyester elastomer. A commercially available product may be used as component B. Illustrative examples include the olefin elastomer Dynaron (JSR Corporation) and the polyester elastomer Hytrel (DuPont-Toray Co., Ltd.). These may be used singly or as combinations of two or more thereof.

The upper limit in the proportion of the above resin components accounted for by component B is generally 50 wt % or less, and preferably 40 wt % or less. If component B accounts for more than 50 wt % of the above resin components, the respective components may have a lower compatibility, which may markedly lower the durability of the golf ball.

Component C in the invention is an organic fatty acid and/or fatty acid derivative having a molecular weight of at least 228 but not more than 1500. It has a much lower molecular weight than the above resin components, and is preferably included because it is a component that suitably adjusts the melt viscosity of the mixture and, in particular, helps to enhance the flow properties.

The organic fatty acid serving as above component C has a molecular weight of generally at least 228, preferably at least 300, more preferably at least 400, and even more preferably at least 500, but generally not more than 1500, preferably not more than 1000, more preferably not more than 800, and even more preferably not more than 600. If the molecular weight is too low, the heat resistance may decrease. On the other hand, if the molecular weight is too high, it may not be possible to improve the flow properties.

It is preferable to use as the organic fatty acid of component C an unsaturated organic fatty acid containing a double bond or triple bond on the alkyl moiety, or a saturated organic fatty acid in which the bonds on the alkyl moiety are all single bonds. The number of carbons in one molecule of the organic fatty acid is generally at least 18, preferably at least 20, more preferably at least 22, and even more preferably at least 24, but generally not more than 80, preferably not more than 60, more preferably not more than 40, and even more preferably not more than 30. Too few carbons, in addition to possibly resulting in a poor heat resistance, may also, by making the acid group content relatively high, lead to excessive interactions with acid groups present in the base resins, thereby diminishing the flow-improving effect. On the other hand, too many carbons increases the molecular weight, as a result of which a distinct flow-improving effect may not be achieved.

Illustrative examples of the organic fatty acid of component C in the present invention include stearic acid, 12-hydroxystearic acid, behenic acid, oleic acid, linoleic acid, linolenic acid, arachidic acid and lignoceric acid. Of these, stearic acid, arachidic acid, behenic acid and lignoceric acid are preferred. Behenic acid is especially preferred.

The organic fatty acid derivative of component C is exemplified by metallic soaps in which the proton on the acid group of the organic fatty acid has been replaced with a metal ion. Examples of the metal ion include $Na^{+}$, $Li^{+}$, $Ca^{++}$, $Mg^{++}$, $Zn^{++}$, $Mn^{++}$, $Al^{+++}$, $Ni^{++}$, $Fe^{++}$, $Fe^{+++}$, $Cu^{++}$, $Sn^{++}$, $Pb^{++}$ and $Co^{++}$. Of these, $Ca^{++}$, $Mg^{++}$ and $Zn^{++}$ are especially preferred.

Specific examples of the organic fatty acid derivative of component C include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred. These may be used singly or in combinations of two or more thereof.

In the intermediate layer material, the amount of component C included per 100 parts by weight of the above resin components (components A and B) is generally at least 5 parts by weight, preferably at least 30 parts by weight, more preferably at least 60 parts by weight, and even more preferably at least 85 parts by weight, but generally not more than 120 parts by weight, preferably not more than 115 parts by weight, more preferably not more than 110 parts by weight, and even more preferably not more than 105 parts by weight. If the amount of component C included is too small, the melt viscosity may become excessively low, reducing the moldability. On the other hand, if the amount of component C is too high, the durability may decrease. In the cover material, the amount of component C included per 100 parts by weight of the resin components is from 0.1 to 10 parts by weight. This is described in detail later in the specification.

In the present invention, use may also be made of, as a mixture of the above-described base resin (A) and the above-described component C, a known metallic soap-modified ionomer (see, for example, U.S. Pat. No. 5,312,857, U.S. Pat. No. 5,306,760 and International Disclosure WO 98/46671).

Component D in the present invention is a basic inorganic metal compound capable of neutralizing unneutralized acid groups in the above resin components and above component C. If component D is not included, such as in cases where a metallic soap-modified ionomeric resin is used alone, during mixture under applied heat the metallic soap and unneutralized acid groups present in the ionomeric resin will undergo exchange reactions, which may generate a large amount of fatty acid that vaporizes, potentially giving rise to problems such as molding defects, lower paint film adhesion, and a decrease in the resilience of the resulting molded material. In the present invention, component D is preferably included so as to resolve such problems.

It is preferable that above component D be a compound having a high reactivity with the resin components and containing no organic acids in the reaction by-products. Illustrative examples of the metal ion in component D include $Li^{+}$, $Na^{+}$, $K^{+}$, $Ca^{++}$, $Mg^{++}$, $Zn^{++}$, $Al^{+++}$, $Ni^{++}$, $Fe^{++}$, $Fe^{+++}$, $Cu^{++}$, $Mn^{++}$, $Sn^{++}$, $Pb^{++}$ and $Co^{++}$. These may be used singly or as combinations of two or more thereof. Known basic inorganic fillers containing these metal ions may be used as component D. Illustrative examples include magnesium oxide, magnesium hydroxide, magnesium carbonate, zinc oxide, sodium hydroxide, sodium carbonate, calcium oxide, calcium hydroxide, lithium hydroxide and lithium carbonate. In particular, a hydroxide or a monoxide is recommended. Calcium hydroxide and magnesium oxide, which have a high reactivity with the base resin, are preferred.

In the intermediate layer material, the amount of above component D included per 100 parts by weight of the above resin components is generally at least 0.1 part by weight, preferably at least 0.5 part by weight, more preferably at least 1 part by weight, and even more preferably at least 2 parts by weight, but generally not more than 17 parts by weight, preferably not more than 15 parts by weight, more preferably not more than 13 parts by weight, and even more preferably not more than 10 parts by weight. If the amount of component D included is too small, improvements in the thermal stability and resilience may not be observed. On the other hand, if it is too large, the presence of excess basic inorganic metal compound may have the opposite effect of lowering the heat resistance of the golf ball material. The cover material has a component D content which, unlike that mentioned above, is from 0.1 to 5 parts by weight per 100 parts by weight of the resin components. This is described in detail later in the specification.

The mixture obtained by mixing above components A to D has a degree of neutralization, based on the total amount of acid groups in the mixture, of generally at least 50 mol %, preferably at least 60 mol %, more preferably at least 70 mol %, and even more preferably at least 80 mol %. With such a high degree of neutralization, even in cases where, for example, a metallic soap-modified ionomeric resin is used, exchange reactions between the metallic soap and unneutralized acid groups present in the ionomeric resin are less likely to arise during mixture under heating, thereby reducing the likelihood of declines in thermal stability, moldability and resilience.

In addition to above components A to D, various additives such as pigments, dispersants, antioxidants, ultraviolet absorbers and light stabilizers may also be included within the above-described intermediate layer and cover materials in the invention. These additives are used in an amount which, although not subject to any particular limitation, is generally at least 0.1 part by weight, preferably at least 0.5 part by weight, and more preferably at least 1 part by weight, but generally not more than 10 parts by weight, preferably not more than 6 parts by weight, and more preferably not more than 4 parts by weight, per 100 parts by weight of the above resin components (components A and B).

The mixed resin material for the intermediate layer in the invention may be obtained by mixing the respective above components A to D under applied heat. For example, the intermediate layer material may be obtained by mastication with an internal mixer such as a kneading-type twin-screw extruder, a Banbury mixer or a kneader at a heating temperature of from 150 to 250° C. Alternatively, direct use may be made of a commercial product, illustrative examples of which include those available under the trade names HPF 1000, HPF 2000 and HPF AD1027, as well as the experimental material HPF SEP1264-3, all produced by E.I. DuPont de Nemours & Co.

Next, the material hardness of the intermediate layer encasing the core, while not subject to any particular limitation, is a value which, expressed as the durometer D hardness (Shore D hardness), is preferably at least 40 but not more than 60, more preferably at least 45 but not more than 55, and even more preferably at least 48 but not more than 50. At a hardness lower than the above range, the ball may take on too much spin on shots with a driver (W#1) or the ball rebound may decrease, as a result of which an increase in distance may not be achieved. On the other hand, at a hardness higher than the above range, the durability of the ball to cracking under repeated impact may worsen. The intermediate layer has a thickness which, while not subject to any particular limitation, is generally at least 0.8 mm but not more than 5.0 mm, preferably at least 1.0 mm but not more than 4.0 mm, and more preferably at least 1.6 mm but not more than 3.0 mm. If the intermediate layer is too thin, the durability to cracking on repeated impact may worsen, or the ball rebound may decrease, resulting in a shorter distance. On the other hand, if the intermediate layer is too thick, the spin rate may rise, resulting in a shorter distance.

Also, it is critical that the intermediate layer have a lower hardness than the cover. The hardness differences (Shore D) between the cover and the intermediate layer is preferably at least 3, more preferably from 5 to 20, and even more preferably from 10 to 17. Outside of this hardness difference range, the spin rate may rise on shots with a W#1, resulting in a shorter distance.

It is preferable for the intermediate layer to be thicker than the cover. If the intermediate layer is thinner than the cover, the spin rate on shots with a W#1 may increase, possibly resulting in a shorter distance.

Next, the cover (outer layer) has a durometer D hardness of preferably at least 50 but not more than 70, more preferably at least 55 but not more than 68, and even more preferably at least 60 but not more than 66. If this cover hardness is too low, the ball may take on too much spin or have an inadequate rebound, possibly resulting in a shorter distance. On the other hand, if the cover is too hard, the durability to cracking on repeated impact may worsen.

The cover thickness is set to at least 0.5 mm but not more than 2.0 mm, preferably at least 0.9 mm but not more than 1.7 mm, and more preferably at least 1.1 mm but not more than 1.4 mm. If the cover is too thick, the ball may take on too much spin, possibly resulting in a shorter distance. On the other hand, if the cover is too thin, the durability to cracking on repeated impact may worsen.

The cover resin material preferably has a melt flow rate adjusted to ensure flow properties that are particularly suitable for injection molding, and thus improve moldability. Here, it is recommended that the melt flow rate (MFR), as measured according to JIS-K7210 at a temperature of 190° C. and under a load of 21.18 N (2.16 kgf), be set to generally at least 1.5 g/10 min, preferably at least 1.8 g/10 min, and more preferably at least 2.2 g/10 min. Too low a melt flow rate may result in a poor cover moldability, a decline in the sphericity of the ball, and an increase in the variability of flight.

As mentioned above, the cover material, like the intermediate layer, preferably is composed primarily of a resin mixture of above components A to D. However, to improve the scuff resistance, above components C and D are preferably adjusted as indicated below.

The organic fatty acid and/or organic fatty acid derivative having a molecular weight of from 228 to 1500 serving as component C is included in an amount, per 100 parts by weight of the base resin (components A and B), of generally from 0.1 to 10 parts by weight, preferably from 0.2 to 7 parts by weight, and more preferably from 0.5 to 4.5 parts by weight. When the amount of component C is greater than the above range, the paint film adhesion strength may decrease. Also, component D is included in an amount, per 100 parts by weight of the above resin components, of generally from 0.1 to 5 parts by weight, preferably from 0.2 to 3 parts by weight, and more preferably from 0.3 to 1 part by weight.

Hardness Relationship Between Intermediate Layer and Cover

As mentioned above, in the present invention, it is critical for the hardnesses of the intermediate layer and the cover as layers per se (also referred to below as the "material hardnesses") to satisfy the relationship:

$$\text{cover hardness} > \text{intermediate layer hardness}.$$

Thickness Relationship Between Intermediate Layer and Cover

In the present invention, it is essential for the thicknesses of the above intermediate layer and cover to satisfy the condition:

$$\text{cover thickness} \leqq \text{intermediate layer thickness},$$

and it is especially preferable for the intermediate layer to be thicker than the cover. The condition $$\text{cover thickness} \times 1.2 \leqq \text{intermediate layer thickness}$$

is more preferred, and the condition $$\text{cover thickness} \times 1.5 \leqq \text{intermediate layer thickness}$$

is especially preferred. If, on the other hand, the cover is thicker than the intermediate layer, the ball rebound may decrease or the ball may incur excessive spin on full shots, as a result of which an increased distance may not be achieved.

The above-described golf ball composed of a core, an intermediate layer and a cover that have been formed as successive layers can be manufactured using an ordinary process such as a known injection molding process. For example, a molded and vulcanized article composed primarily of a rubber material may be placed as the core within a particular injection mold, following which the intermediate layer material may be injection-molded to give an intermediate spherical body. The spherical body may then be placed within another injection mold and the cover material injection-molded over the spherical body to give a multi-piece golf ball. Alternatively, the respective layers may be successively formed over the intermediate spherical body by, for example, placing two half-cups, molded beforehand as hemispherical shells, around the intermediate spherical body so as to encase it, then molding under applied heat and pressure.

Numerous dimples may be formed on the surface of the cover. The dimples arranged on the cover surface, while not subject to any particular limitation, number preferably at least 280 but not more than 360, more preferably at least 300 but not more than 350, and even more preferably at least 320 but not more than 340. If the number of dimples is higher than the above range, the ball will tend to have a low trajectory, which may shorten the distance of travel. On the other hand, if the number of dimples is too low, the ball will tend to have a high trajectory, as a result of which an increased distance may not be achieved.

Any one or combination of two or more dimple shapes, including circular shapes, various polygonal shapes, dewdrop shapes and oval shapes, may be suitably used. If circular dimples are used, the diameter of the dimples may be set to at least about 2.5 mm but not more than about 6.5 mm, and the depth may be set to at least 0.08 mm but not more than 0.30 mm.

To fully manifest the aerodynamic characteristics of the dimples, the dimple coverage on the spherical surface of the golf ball, which is the sum of the individual dimple surface areas, each defined by the surface area of the flat plane circumscribed by the edge of the dimple, expressed as a ratio (SR) with respect to the spherical surface area of the ball were it to be free of dimples, is preferably at least 60% but not more than 90%. Also, to optimize the trajectory of the ball, the value $V_0$ obtained by dividing the spatial volume of each dimple below the flat plane circumscribed by the edge of that dimple by the volume of a cylinder whose base is the flat plane and whose height is the maximum depth of the dimple from the base is preferably at least 0.35 but not more than 0.80. In addition, the VR value, which is the sum of the volumes of the individual dimples formed below the flat plane circumscribed by the dimple edge, as a percentage of the volume of the ball sphere were it to have no dimples thereon, is preferably at least 0.6% but not more than 1.0%. Outside of the above ranges for these values, the ball may assume a trajectory that is not conducive to achieving a good distance, as a result of which the ball may not travel a sufficient distance when played.

The golf ball of the invention, which can be manufactured so as to conform with the Rules of Golf for competitive play, may be produced to a ball diameter which is of a size that will not pass through a ring having an inside diameter of 42.672 mm, but is not more than 42.80 mm, and to a weight of generally from 45.0 to 45.93 g.

As shown above, by optimizing the hardnesses of the intermediate layer and the cover (outer layer), and by optimizing the core hardness profile, the golf ball of the present invention provides an excellent flight performance for amateur golfers having a moderate head speed, and also has an excellent durability to cracking under repeated impact.

EXAMPLES

Examples of the invention and Comparative Examples are given below by way of illustration, and not by way of limitation.

Examples 1 to 3, Comparative Examples 1 to 4

Formation of Core

Rubber compositions were formulated as shown in Table 1, then molded and vulcanized under the conditions shown in Table 1 to form cores.

TABLE 1

| | | Example | | | Comparative Example | | | |
|---|---|---|---|---|---|---|---|---|
| | | 1 | 2 | 3 | 1 | 2 | 3 | 4 |
| Core formulation (pbw) | Polybutadiene A | 0 | 0 | 0 | 90 | 0 | 0 | 0 |
| | Polybutadiene B | 70 | 70 | 70 | 0 | 70 | 70 | 70 |
| | Polybutadiene C | 20 | 20 | 20 | 0 | 20 | 20 | 20 |
| | Polyisoprene rubber | 10 | 10 | 10 | 10 | 10 | 10 | 10 |
| | Zinc acrylate | 24.2 | 23.2 | 22.1 | 25 | 29.3 | 24.2 | 24.2 |
| | Peroxide (1) | 0 | 0 | 0 | 0.6 | 0 | 0 | 0 |
| | Peroxide (2) | 1.2 | 1.2 | 1.2 | 0.6 | 3 | 1.2 | 1.2 |
| | Antioxidant (1) | 0.1 | 0.1 | 0.1 | 0.1 | 0 | 0.1 | 0.1 |
| | Antioxidant (2) | 0 | 0 | 0 | 0 | 0.1 | 0 | 0 |
| | Zinc oxide | 37.4 | 37.8 | 38.2 | 37.5 | 36.7 | 37.4 | 20.5 |
| | Sulfur | 0 | 0 | 0 | 0 | 0.1 | 0 | 0 |
| | Zinc stearate | 0 | 0 | 0 | 0 | 5 | 0 | 0 |

TABLE 1-continued

| | | Example | | | Comparative Example | | | |
|---|---|---|---|---|---|---|---|---|
| | | 1 | 2 | 3 | 1 | 2 | 3 | 4 |
| Vulcanization | Temperature (° C.) | 156 | 156 | 156 | 155 | 156 | 156 | 156 |
| | Time (minutes) | 15 | 15 | 15 | 15 | 15 | 15 | 15 |

Trade names for the chief materials appearing in the table are given below.
Polybutadiene A: Available from JSR Corporation under the trade name "BR 01"
Polybutadiene B: Available from JSR Corporation under the trade name "BR 730"
Polybutadiene C: Available from JSR Corporation under the trade name "BR 51"
Polyisoprene rubber: Available from JSR Corporation under the trade name "IR 2200"
Peroxide (1): Dicumyl peroxide, produced by NOF Corporation under the trade name "Percumyl D"
Peroxide (2): A mixture of 1,1-di(t-butylperoxy)-cyclohexane and silica, produced by NOF Corporation under the trade name "Perhexa C-40"
Antioxidant (1): 2,2'-Methylenebis(4-methyl-6-t-butyl-phenol), produced by Ouchi Shinko Chemical Industry Co., Ltd. under the trade name "Nocrac NS-6"
Antioxidant (2): 2,6-di-t-butyl-4-methylphenol, produced by Ouchi Shinko Chemical Industry Co., Ltd. under the trade name "Nocrac 200"
Zinc stearate: Available from NOF Corporation under the trade name "Zinc Stearate G"

Formation of Intermediate Layer and Cover

Figure 4:
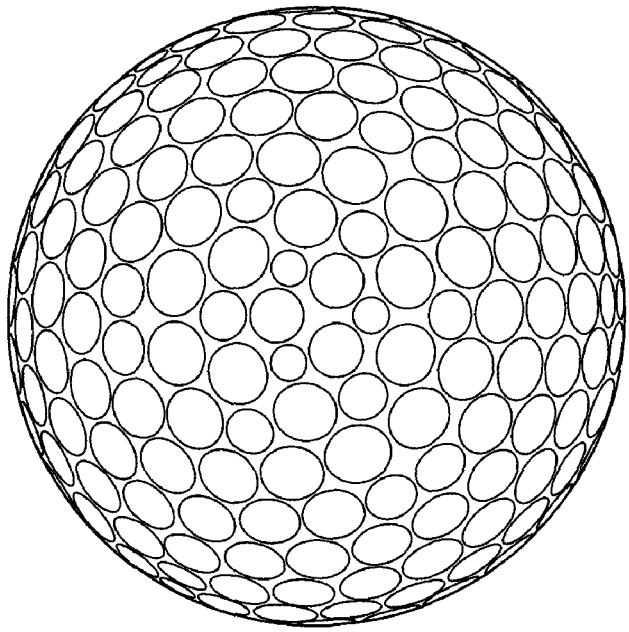
FIG. 4 is a top view of a golf ball showing the arrangement of dimples used in the examples of the invention and in the comparative examples.

Next, an intermediate layer and a cover formulated from the various resin components shown in Table 2 were each injection-molded, thereby forming over the core, in order, an intermediate layer and a cover. Golf balls were then produced by forming dimples on the surface of the cover in the common dimple configuration shown in Table 3 below and FIG. 4.

TABLE 2

| Intermediate layer/cover formulations (pbw) | ① | ② | ③ |
|---|---|---|---|
| Surlyn 7940 | | 100 | |
| Surlyn 8120 | | | 35 |
| Himilan 1855 | | | 35 |
| AN 4319 | 100 | | |
| AN 4311 | | | 30 |
| Magnesium oxide | 2.8 | | |
| Calcium hydroxide | | 0.4 | |
| Titanium oxide | | 2.8 | 2.8 |
| Magnesium stearate | 100 | 1.7 | |
| Bluing agent (blue pigment) | | 0.1 | 0.1 |

Trade names for the chief materials appearing in the table are given below.
Surlyn: Ionomer resins produced by E.I. DuPont de Nemours & Co.
Himilan: An ionomer resin produced by DuPont-Mitsui Polychemicals Co., Ltd.
AN 4311, AN 4319: "Nucrel" produced by DuPont-Mitsui Polychemicals Co., Ltd.
Magnesium oxide: "Kyowamag MF150" produced by Kyowa Chemical Industry Co., Ltd.
Calcium hydroxide: CLS-B, produced by Shiraishi Kogyo.

TABLE 3

| No. | Number of dimples | Diameter (mm) | Depth (mm) | $V_0$ | SR | VR |
|---|---|---|---|---|---|---|
| 1 | 12 | 4.6 | 0.15 | 0.47 | 0.81 | 0.783 |
| 2 | 234 | 4.4 | 0.15 | 0.47 | | |
| 3 | 60 | 3.8 | 0.14 | 0.47 | | |
| 4 | 6 | 3.5 | 0.13 | 0.46 | | |
| 5 | 6 | 3.4 | 0.13 | 0.46 | | |
| 6 | 12 | 2.6 | 0.10 | 0.46 | | |
| Total | 330 | | | | | |

Dimple Definitions
Diameter: Diameter of flat plane circumscribed by edge of dimple.
Depth: Maximum depth of dimple from flat plane circumscribed by edge of dimple.
$V_0$: Spatial volume of dimple below flat plane circumscribed by dimple edge, divided by volume of cylinder whose base is the flat plane and whose height is the maximum depth of dimple from the base.
SR: Sum of individual dimple surface areas, each defined by the surface area of the flat plane circumscribed by the edge of a dimple, as a percentage of surface area of ball sphere were it to have no dimples thereon.
VR: Sum of volumes of individual dimples formed below flat plane circumscribed by the edge of the dimple, as a percentage of volume of ball sphere were it to have no dimples thereon.

The golf balls obtained in Examples 1 to 3 of the invention and in Comparative Examples 1 to 4 were tested and evaluated according to the criteria described below with regard to the following: properties such as thickness and hardness of each layer, flight performance, durability to repeated impact, and scuff resistance. The results are shown in Table 4.

(1) Core Deflection

The core was placed on a hard plate, and the deflection (mm) by the core when compressed under a final load of 1,275 N (130 kgf) from an initial load of 98 N (10 kgf) was measured. The average of ten measurements (N=10 balls) was determined.

(2) Core Surface Hardness

The core was cut in half, forming a flat face. The durometer indenter was set substantially perpendicular to this flat face, the JIS-C hardness was measured (in accordance with JIS-K6301) at the center of the core, and this results was treated as the measured value for one ball. The average of three measurements (N=3 balls) was determined.

(3) Cross-Sectional Hardness of Core at 7.5 mm from Center

The core was cut in half, forming a flat face. The durometer indenter was set substantially perpendicular to this flat face, and the JIS-C hardness was measured (in accordance with JIS-K6301) at one point (one place 7.5 mm from the center) on each of the pair of hemispherical cores obtained by cutting the core in half. The average of the two measurements was determined, and treated as the measured value for a single ball. Next, the average of the measurements obtained for three balls (N=3) was determined.

(4) Cross-Sectional Hardness of Core at 15 mm from Center

Measurement was carried out in the same way as in (3) above.

(5) Core Surface Hardness

The surface of the core is spherical. The durometer indenter was set substantially perpendicular to this spherical surface, and JIS-C hardness measurements (in accordance with JIS-K6301) were taken at two randomly selected points on the surface of the core. The average of the two measurements was determined, and treated as the measured value for a single ball. Next, the average of the measurements obtained for three balls (N=3) was determined.

(6) Intermediate Layer and Cover Hardnesses (Material Hardnesses)

The resin materials for the intermediate layer and the cover were formed into sheets having a thickness of about 2 mm, and the hardnesses were measured with a type D durometer in accordance with ASTM D-2240. The average of ten measurements (N=10 sheets) was determined.

(7) Flight

The flight of the ball when hit at a head speed of 35 m/s with a W#1 mounted on a golf swing robot was measured. The club was a TourStage V-Iq driver (loft angle, 11.75°) manufactured by Bridgestone Sports Co., Ltd. The average of ten measurements (N=10 balls) was determined.

The results were rated according to the criteria indicated below. The spin rate was the value obtained by measuring the ball, immediately after impact, with an apparatus for measuring initial conditions.

Good: Total distance was 153.0 m or more

NG: Total distance was less than 153.0 m (8) Durability to Repeated Impact

The ball was repeatedly hit at a head speed of 35 m/s with a W#1 club mounted on a golf swing robot. The balls in the respective examples were rated as shown below relative to an arbitrary durability index of 100 for the number of shots taken with the ball in Example 3 before the initial velocity fell below 97% of the average initial velocity for the first 10 shots. The average value of three measurements (N=3 balls) was used as the basis for evaluation in each example.

Good: Durability index was 90 or more

NG: Durability index was less than 90

(6) Scuff Resistance

A non-plated pitching sand wedge was set in a swing robot, and the ball was hit once at a head speed of 35 m/s, following which the surface state of the ball was visually examined and rated as follows for N=3 balls.

Good: Can be used again

NG: Cannot be used again

TABLE 4

| | | Example | | | Comparative Example | | | |
|---|---|---|---|---|---|---|---|---|
| | | 1 | 2 | 3 | 1 | 2 | 3 | 4 |
| Core | Diameter (mm) | 35.0 | 35.0 | 35.0 | 35.0 | 35.0 | 35.0 | 40.2 |
| | Weight (g) | 28.1 | 28.1 | 28.1 | 28.1 | 28.1 | 28.1 | 39.1 |
| | Deflection, 10-130 kgf (mm) | 3.7 | 4.1 | 4.4 | 3.7 | 3.7 | 3.7 | 3.7 |
| | Surface hardness (S) (JIS-C hardness) | 81 | 79 | 77 | 75 | 85 | 81 | 82 |
| | 15 mm from center (JIS-C hardness) | 76 | 74 | 72 | 76 | 73 | 76 | 76 |
| | 7.5 mm from center (JIS-C hardness) | 68 | 67 | 66 | 70 | 72 | 68 | 68 |
| | Center hardness (C) (JIS-C hardness) | 61 | 60 | 59 | 64 | 65 | 61 | 61 |
| | Average (A) for 15 mm from center and center (JIS-C hardness) | 68.5 | 67.0 | 65.5 | 70.0 | 69.0 | 68.5 | 68.5 |
| | 7.5 mm from center − (A) (JIS-C hardness) | −0.5 | 0.0 | 0.0 | 0.0 | 3.0 | −0.5 | −0.5 |
| | (S) − (C) (JIS-C hardness) | 20 | 19 | 18 | 11 | 20 | 20 | 21 |
| Intermediate layer | Material (type) | ① | ① | ① | ① | ① | ① | — |
| | Thickness (mm) | 2.6 | 2.6 | 2.6 | 2.6 | 2.6 | 2.6 | — |
| | Specific gravity | 0.95 | 0.95 | 0.95 | 0.95 | 0.95 | 0.95 | — |
| | Sheet (Shore D hardness) | 49 | 49 | 49 | 49 | 49 | 49 | — |
| Intermediate layer-encased sphere | Diameter (mm) | 40.2 | 40.2 | 40.2 | 40.2 | 40.2 | 40.2 | — |
| | Weight (g) | 39.1 | 39.1 | 39.1 | 39.1 | 39.1 | 39.1 | — |
| Cover | Material (type) | ② | ② | ② | ② | ② | ③ | ② |
| | Thickness (mm) | 1.25 | 1.25 | 1.25 | 1.25 | 1.25 | 1.25 | 1.25 |
| | Specific gravity | 0.96 | 0.96 | 0.96 | 0.96 | 0.96 | 0.96 | 0.96 |
| | Sheet (Shore D hardness) | 64 | 64 | 64 | 64 | 64 | 48 | 64 |
| Ball | Diameter (mm) | 42.7 | 42.7 | 42.7 | 42.7 | 42.7 | 42.7 | 42.7 |
| | Weight (g) | 45.5 | 45.5 | 45.5 | 45.5 | 45.5 | 45.5 | 45.5 |
| Flight (W#1; HS, 35 m/s) | Spin rate (rpm) | 3535 | 3488 | 3412 | 3601 | 3585 | 3646 | 3470 |
| | Total distance (m) | 153.6 | 154.0 | 154.5 | 151.9 | 152.5 | 149.9 | 154.1 |
| | Rating | good | good | good | NG | NG | NG | good |
| Durability to repeated impact | Rating | good | good | good | good | good | good | NG |
| Scuff resistance | Rating | good | good | good | good | good | NG | good |

The golf balls of Examples 1 to 3 according to the present invention were excellent with respect to all the properties of concern: flight performance in terms of distance, durability to repeated impact, and scuff resistance. The results obtained for the golf balls in the comparative examples were as follows.

In the golf ball of Comparative Example 1, because the core surface-core center hardness difference (JIS-C hardness) was less than 15, the ball had a high spin rate, resulting in a poor distance.

In the golf ball of Comparative Example 2, because the core hardness profile was not linear, the spin rate-lowering effect was inadequate, resulting in a poor distance.

In the golf ball of Comparative Example 3, because the cover had a lower hardness than the intermediate layer, the spin rate was high and the rebound was low, resulting in a poor distance.

In the golf ball of Comparative Example 4, because the ball had a two-piece structure composed of a core and a cover, the durability to cracking on repeated impact was poor.

The invention claimed is:

1. A golf ball comprising a core, an intermediate layer encasing the core, and a cover which encases the intermediate layer and has formed on a surface thereof a plurality of dimples, wherein the core is formed primarily of a rubber material; the intermediate layer and the cover are formed primarily of like or unlike resin materials; the core has a hardness which gradually increases from a center to a surface thereof, the hardness difference in JIS-C hardness units between the core center and the core surface being at least 15 and, letting (I) be the average value for cross-sectional hardnesses at a position about 15 mm from the core center and at the core center and letting (II) be the cross-sectional hardness at a position about 7.5 mm from the core center, the hardness difference (I)-(II) in JIS-C units being not more than +2; and the intermediate layer and cover have hardnesses which satisfy the condition:

cover hardness>intermediate layer hardness, wherein the core is a single layer, the intermediate layer is a single layer and the cover is a single layer, wherein the resin material of the intermediate layer is a mixture comprising:

100 parts by weight of a resin component comprised of (A) a base resin containing (a-1) an olefin-unsaturated carboxylic acid random copolymer and/or a metal ion neutralization product of an olefin-unsaturated carboxylic acid random copolymer and (a-2) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in proportions of (a-1)/(a-2)=100/0 to 0/100 (weight ratio), and (B) a non-ionomeric thermoplastic elastomer in proportions of A/B=100/0 to 50/50 (weight ratio);

(C) from 85 to 110 parts by weight of an organic fatty acid and/or organic fatty acid derivative having a molecular weight of from 228 to 1500; and (D) from 0.1 to 17 parts by weight of a basic inorganic metal compound capable of neutralizing unneutralized acid groups in the resin component and component C, wherein the golf ball comprises three layers and the intermediate layer contacts the cover and the core.

2. The golf ball of claim 1, wherein the intermediate layer and cover have thicknesses which satisfy the condition:

cover thickness≦intermediate layer thickness.

3. The golf ball of claim 1, wherein the resin material of the cover is a mixture comprising:

100 parts by weight of a resin component comprised of (A) a base resin containing (a-1) an olefin-unsaturated carboxylic acid random copolymer and/or a metal ion neutralization product of an olefin-unsaturated carboxylic acid random copolymer and (a-2) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in proportions of (a-1)/(a-2)=100/0 to 0/100 (weight ratio), and (B) a non-ionomeric thermoplastic elastomer in proportions of A/B=100/0 to 50/50 (weight ratio);

(C) from 0.1 to 10 parts by weight of an organic fatty acid and/or organic fatty acid derivative having a molecular weight of from 228 to 1500; and (D) from 0.1 to 5 parts by weight of a basic inorganic metal compound capable of neutralizing unneutralized acid groups in the resin component and component C.

4. The golf ball of claim 1, wherein the hardness difference (I)-(II) in JIS-C units is not more than ±1.

5. The golf ball of claim 1, wherein the intermediate layer and the cover have thicknesses which satisfy the condition:

cover thickness×1.5 intermediate≦layer thickness.

6. The golf ball of claim 3, wherein component C is included in an amount of from 0.5 to 4.5 parts by weight per 100 parts by weight of the resin component.

* * * * *